US005265359A

United States Patent [19]

Glazer et al.

[11] Patent Number: 5,265,359

[45] Date of Patent: Nov. 30, 1993

[54] DISPLAY FRAME

[76] Inventors: Bennett Glazer, 128 Verbena Ave., Floral Park, N.Y. 11001; Thomas J. Glazer, 14 Biarritz St., Lido Beach, N.Y. 11561

[21] Appl. No.: 834,764

[22] Filed: Feb. 13, 1992

[51] Int. Cl.[5] ..... G09F 1/10

[52] U.S. Cl. ..... 40/159; 402/79; 40/158.1

[58] Field of Search ..... 40/152, 158.1, 159, 40/537, 159.1, 124.2, 124.4; 402/79; 281/22, 24, 38

[56] References Cited

U.S. PATENT DOCUMENTS

| | | | |
|---|---|---|---|
| 163,212 | 5/1875 | Kullrich | 40/159 X |
| 2,701,426 | 2/1955 | Vlock | 40/159 |
| 3,921,322 | 11/1975 | Sharp | 40/159 X |

*Primary Examiner*—Kenneth J. Dorner
*Assistant Examiner*—Brian K. Green
*Attorney, Agent, or Firm*—Young & Thompson

[57] ABSTRACT

A display frame includes a backing sheet having a spacer secured thereto and a mat overlying and secured to the spacer. The mat has a window defined by four edges, this mat window being smaller in each direction than a window in the spacer. The edges of the mat window meet in corners. Slits begin at each of two adjacent corners of the mat window and proceed away from opposite ends of one edge of the mat window. These slits have closed ends remote from the ends of that edge and are of a length sufficient to permit an image to be inserted within the frame, this image having dimensions greater than those of the frame window but no greater than those of the spacer window, by raising opposite edges of the frame window adjacent the slits and inserting the image beneath the raised edges, moving the image in one direction until a trailing edge of the image clears that one edge of the mat window, and then moving the image in the opposite direction to move its trailing edge beneath the one edge of the mat window.

3 Claims, 2 Drawing Sheets

DISPLAY FRAME

FIELD OF THE INVENTION

The present invention relates to a frame, more particularly of the kind in which a mat frames an image to be displayed. In such frames, the mat is spaced from a backing sheet by a spacer. The mat window is smaller than the image, but the window in the spacer is at least as large as the image and of a thickness at least as great as that of the image, to center the image in the mat window between the mat and the backing sheet.

BACKGROUND OF THE INVENTION

In free-standing easel-back frames or piano frames, or in passe-partout assemblies, the backing sheet and spacer and mat are separable elements that are held together in the former instance in a separable rigid frame and in the latter instance by strips of cloth or paper pasted over the edges. Such assemblies, of course, are relatively heavy and expensive and are often glazed and so are used in the manner of ordinary pictures.

The field of use of the present invention is quite different from that of those heavier individual mountings described immediately above. The present invention relates to that field of mounting in which it is desired to display one or a plurality of images, singly or in assembly, as thin, inexpensive sheets which can be assembled in albums or books in loose-leaf or permanently bound fashion, or as greeting cards and the like.

In these latter constructions, it would be highly desirable to be able to market the display frame as an assembled unit of backing sheet, spacer and mat, ready to receive the image inserted by the user. However, it is difficult to make such an assembly which will be both permanent and easy to use. The assembly should provide a definitive position for the image, from which the image cannot readily become displaced. Thus, in such an assembly, the image should be easy to insert and remove, but secure against accidental dislodgement or mispositioning.

A construction for this purpose has been proposed, in SAMES U.S. Pat. No. 2,253,814 of Aug. 26, 1941. In this construction, a slit is provided across the backing sheet, through which the image can be inserted to a position in which the image is bordered by the spacer and hence framed by the mat.

But this prior art construction has several disadvantages. In the first place, it is often desirable to make such display frames double sided, so that they can display a picture on opposite sides. Especially if the frames are assembled in an album or book, the thickness of the assembly can be substantially reduced if the frames are double sided. In the second place, the side of the display frame opposite the image is rendered unsightly by in effect being slashed across its width.

OBJECTS OF THE INVENTION

It is accordingly an object of the present invention to provide a display frame which will be desirably thin but which will at the same time easily receive and securely retain an image therein against inadvertent displacement.

Another object of the present invention is to provide such a display frame, whose structure for permitting insertion and removal of images is inconspicuous.

Still another object of the present invention is the provision of such a display frame, which resists damage or disfigurement upon insertion and removal of images.

Finally, it is an object of the present invention to provide such a display frame, which will be simple and inexpensive to manufacture, easy to manipulate, and rugged and durable in use.

SUMMARY OF THE INVENTION

Briefly stated, the above objects of the invention are achieved, by providing a display frame in which the mat is slit at two adjacent corners of the mat window, in such a way as to permit limited deformation of the mat upon insertion or removal of an image. The slits are so disposed as to increase one dimension of the mat window, from a dimension less than the corresponding dimension of the image to be inserted, to a dimension greater than that same dimension of the image to be inserted. In a preferred embodiment, the ends of the slit are disposed at a substantial angle to each other, so that any tendency of the mat to tear in prolongation of the slits is minimized. According to another preferred feature, the slits initially extend in prolongation of one of the edges of the mat window, and are most preferably semicircular.

BRIEF DESCRIPTION OF THE INVENTION

Other objects, features and advantages of the present invention will become apparent from the following description, taken in connection with the accompanying drawings, in which.

DETAILED DESCRIPTION OF THE PREFERRED EMBODIMENT

Figure 1:
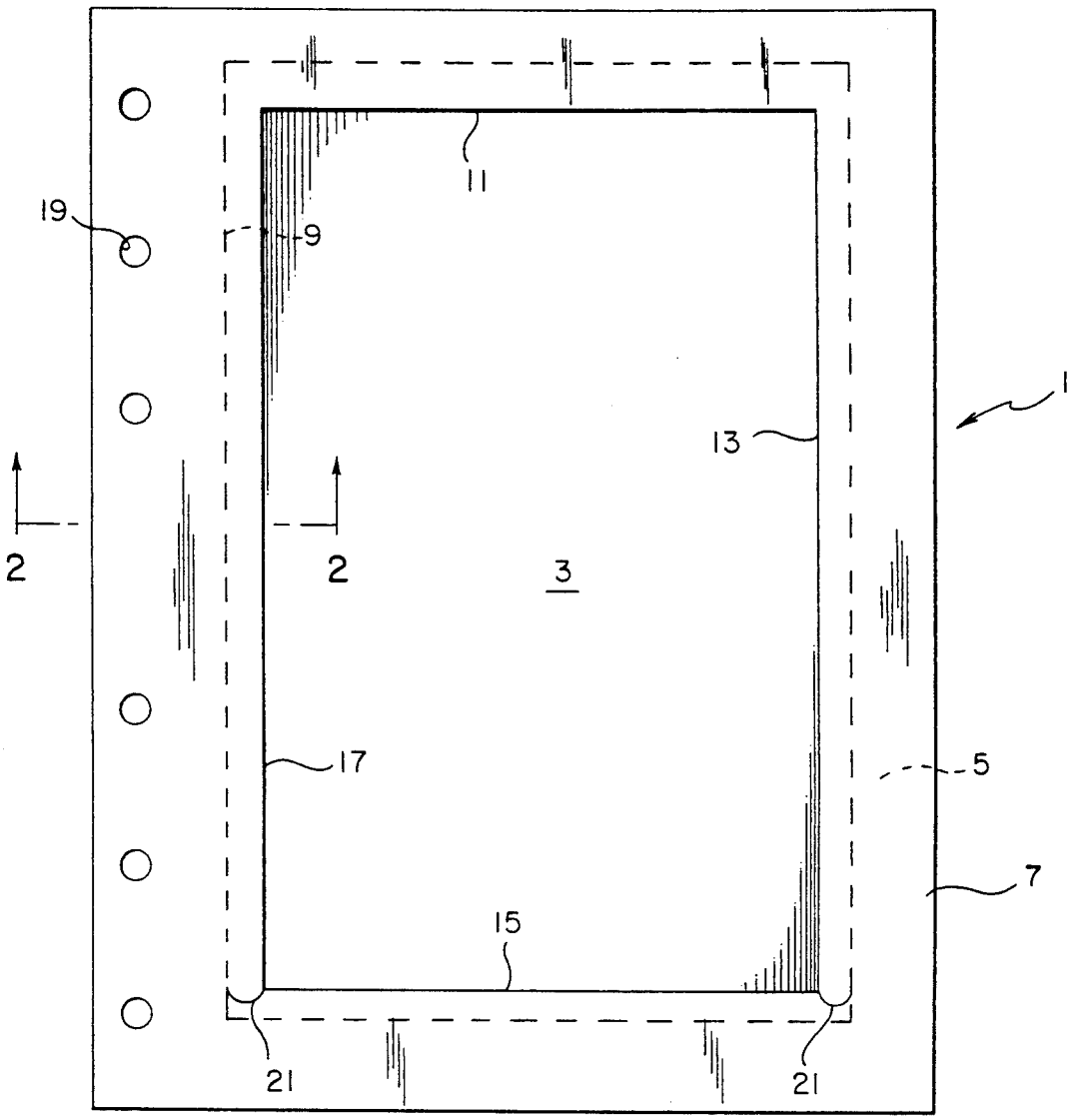
FIG. 1 is a front view of a spacer frame according to the present invention.

Referring now to the drawings in greater detail, and first to FIG. 1 thereof, there is shown a spacer frame 1 according to the invention, in the form of a flat rectangular assembly of small thickness, comprising a backing sheet 3 whose outer edges are coterminous with those of frame 1. A spacer 5 is adhesively secured as by gluing to each side of backing sheet 3, and the outer edges of the spacers 5 are coterminous with those of backing sheet 3. A mat 7 is adhesively secured to the outer surface of each spacer 5, and the outer edge of each mat 7 is coterminous with the outer edges of backing sheet 3 and spacers 5.

Figure 2:
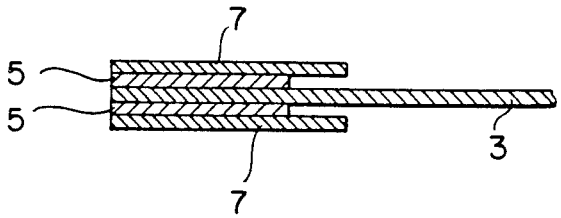
FIG. 2 is an enlarged fragmentary cross sectional view along the line 2—2 of FIG. 1.

The inner edge 9 of spacer 5 is of larger dimensions in each direction than the inner edges 11, 13, 15 and 17 of mat 7, which inner edges 11–17 define the mat window. There is thus an air pocket, shown in FIG. 2, on each side of backing sheet 3, and on the inner side of each mat 7. It is within this air pocket that the image is received.

Notice that this air pocket is wider between mat edge 11 and the corresponding edge 9 of spacer 5, at the upper end of the frame, than at the lower end of the frame, for a reason that will be given hereinafter.

The edge of frame 1 parallel to mat edge 17 may be provided with a series of holes 19 for the assembly of a plurality of the display frames in a loose-leaf binder. Alternatively, of course, the frames could be bound together permanently in a book, or they could be in the form of individual frames such as greeting cards, in which two latter cases the holes 19 would not be present.

In the display frame as described thus far, the backing sheet 3, the spacers 5 and the mat 7 are adhesively secured together continuously about all four sides of the frame. It is thus impossible, with the structure described thus far, to insert into the air pocket provided by spacer 5 between a mat 7 and the backing sheet 3, an image whose dimensions are greater than those of the mat window.

The present invention solves this problem and achieves the objects recited above, by providing slits 21 in only the mat 7, at two adjacent corners of the mat window. The slits are as narrow as possible and have side walls that lie against each other when the mat 7 adjacent the slits is flat, that is, undeformed.

Figure 3:
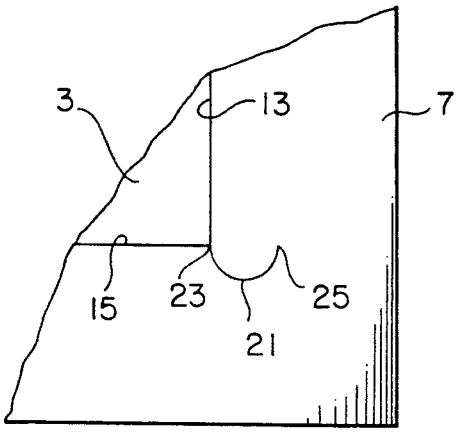
FIG. 3 is an enlarged fragment of the lower right corner of FIG. 1.

In the most preferred embodiment, shown in FIGS. 1 and 3, the slits 21 are arcuate, preferably semicircular, and have an end 23 extending from the associated corner of the mat window, preferably tangent to, and hence in continuation of, mat edges 13 and 17. In the most preferred embodiment, the slits 21 terminate in closed ends 25 which are disposed at a substantial angle, preferably about 180° as in FIGS. 1 and 3, to ends 23. Preferably, the ends 25 are disposed at about 90° to mat edge 15 and, in the most preferred embodiment, do not extend toward mat edge 11 farther than a prolongation of mat edge 15. In other words, if a horizontal line were drawn in FIG. 3, overlying mat edge 15 but extending to the right beyond mat edge 15, slit end 25 would not extend above that line.

The horizontal distance between ends 23 and 25, as seen in FIG. 3, and hence what might be called the span of slits 21, is preferably about the same as the distance between mat edges 13 and 17 and the adjacent spacer edge 9. Wider than this, the slit is unnecessarily wide and hence becomes more conspicuous to the eye. Narrower than this, the slit will not accommodate images of the maximum size permitted by the dimensions of spacer 5. Naturally, it is desirable to match the size of the image as closely as possible to the maximum permitted by spacer 5, so as to avoid misalignment of the image after insertion.

The manner of use of the display frame of the invention is as follows:

To insert an image (not shown) in the display frame, the user slightly raises first one of the edges 13 and 17 of mat 7 adjacent the associated slit 21, and inserts one corner of the image beneath the raised tab thus bordered downwardly by slit 21. The lower end of the other edge 13 or 17 is then raised and the other entering corner of the image inserted thereunder, after which the image can be slid upward, that is, toward the top of the display frame, beneath the edges 13 and 17 of mat 7, until the leading edge of the image comes to rest against the spacer edge 9 at the top of the frame. At this point, the trailing edge of the image will have just cleared mat edge 15, so that the trailing edge can then be inserted, by retrograde or downward movement of the image, into the air pocket at the lower end of the frame, that is, at the bottom of FIG. 1.

But because the air pocket at the lower end of the frame is narrower than the air pocket at the upper end of the frame, the image will come to rest against spacer edge 9 at the lower end of the frame without exposing the upper or leading edge of the image, which will remain masked by edge 11 of mat 7 although spaced from the upper spacer edge 9 of spacer 5 by a distance equal to the width of the lower air pocket adjacent mat edge 15. Thus it will be seen why the upper air pocket is made wider than the lower air pocket.

In this finally assembled condition of the display frame, the frame can be held upright without the image shifting position, because the lower edge of the image will already rest against the lower edge of the air pocket, that is, spacer edge 9 adjacent mat edge 15.

The natural resiliency of the cardboard or heavy paper materials from which mat 7 is made, ensures that once the insertion operation has been performed, the tabs defined by slits 21 will either return to their original position flush with the rest of mat 7, or can be returned to that position by slight pressure of the fingers. In this flush position, the slits 21 being very narrow, they are almost imperceptible to the eye.

Hence, the desirability of positioning slits 21 at the bottom of the frame will be apparent: it is by first inserting the image upwardly, and then slightly returning it downwardly, that the image can be positioned with no possibility to shift thereafter.

Hence, if slits 21 were at the top of the frame, the rest position of the image against the lowermost edge of the air pocket would expose to view the upper edge of the image. Similarly, if the slits 21 were at the intersections of mat edges 11 and 13, on the one hand, and 13 and 15, on the other hand, that is, at the right side of FIG. 1, then the image could be subject to misalignment upon shifting in a horizontal direction.

Figure 4:
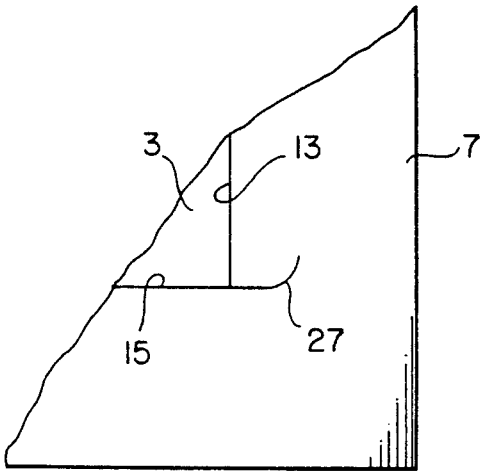
FIG. 4 is a view similar to FIG. 3, but showing a less preferred embodiment of the invention.

Although the particular shape of slits 21 shown in FIGS. 1 and 3 is the best known, other less desirable slit configurations are also conceivable. One of these is shown in FIG. 4, in which the slits 27 are in prolongation of mat edge 15 and then turn away from the direction of edge 15 upwardly. This configuration, however, is less preferred, because it tends more easily to become dog-eared, and also the imposition of stresses on the closed end of the slit, because of the orientation of the slit, seems to increase the tendency of the material of mat 7 to tear in prolongation of the closed end of the slit, as compared to slits 21 of FIGS. 1 and 3.

Figure 5:
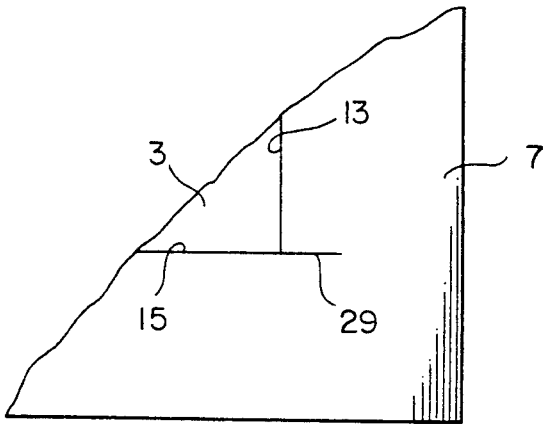
FIG. 5 is a view similar to FIGS. 3 and 4, but showing a still less preferred embodiment of the invention.

Similarly, a still less preferred embodiment is shown in FIG. 5, in which the slits 29 are straight and in continuous prolongation of mat edge 15 in opposite directions. Not only do the corners of mat 7 bounded by slits 29 and mat edges 13 and 17 have a tendency to become dog-eared, but also the mat 7 has a greater tendency to tear in prolongation of the slits 29, than if the closed end of the slit is directed at a substantial angle to the other end of the slit.

Various materials can be used for the backing sheet 3 and the spacer 5; but for convenience and economy, it is preferred that heavy paper be used. Mat 7 should be of heavy paper or the like, not only because this is traditional in matted images, but also because of the simplicity, economy and elegance that the use of heavy paper affords. Thus, the present invention provides, among other things, a way of greatly reducing the tendency of such heavy paper to tear and/or become dog-eared, as a result of insertion or removal of images.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a display frame comprising a backing sheet having a spacer secured thereto and a mat overlying and secured to the spacer, the mat having a window defined by four edges, the mat window being smaller in each direction than a window in said spacer, the edges of the mat window meeting in corners; the improvement comprising slits beginning at each of two adjacent corners of the mat window and proceeding away from opposite ends of one edge of the mat window, said slits having closed ends remote from said ends of said one edge and being of a length sufficient to permit an image to be inserted within the frame, said slits being arcuate.

2. A display frame as claimed in claim 1, said slits being semicircular.

3. In a display frame comprising a backing sheet having a spacer secured thereto and a mat overlying and secured to the spacer, the mat having a window defined by four edges, the mat window being smaller in each direction than a window in said spacer, the edges of the mat window meeting in corners; the improvement comprising slits beginning at each of two adjacent corners of the mat window and proceeding away from opposite ends of one edge of the mat window, said slits having closed ends remote from said ends of said one edge and being of a length sufficient to permit an image to be inserted within the frame, each said slit being defined by two edges that lie against each other and have the same direction and shape.

* * * * *